US009210794B2

(12) United States Patent
Mitsumoto

(10) Patent No.: US 9,210,794 B2
(45) Date of Patent: Dec. 8, 2015

(54) CYCLOTRON

(71) Applicant: SUMITOMO HEAVY INDUSTRIES, LTD., Tokyo (JP)

(72) Inventor: Toshinori Mitsumoto, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 127 days.

(21) Appl. No.: 14/093,855

(22) Filed: Dec. 2, 2013

(65) Prior Publication Data

US 2014/0152198 A1 Jun. 5, 2014

(30) Foreign Application Priority Data

Dec. 3, 2012 (JP) ..... 2012-264564

(51) Int. Cl.

| | |
|---|---|
| ***H05H 13/00*** | (2006.01) |
| ***H05H 7/10*** | (2006.01) |
| ***H05H 7/02*** | (2006.01) |
| ***H05H 7/00*** | (2006.01) |

(52) U.S. Cl.

CPC . *H05H 7/02* (2013.01); *H05H 7/00* (2013.01); *H05H 13/005* (2013.01)

(58) Field of Classification Search

USPC ..... 315/291–311

See application file for complete search history.

(56) References Cited

U.S. PATENT DOCUMENTS

| | | | | |
|---|---|---|---|---|
| 3,363,138 | A * | 1/1968 | Gruber et al. | 315/39 |
| 5,548,183 | A * | 8/1996 | Miyoshi et al. | 313/153 |
| 6,683,426 | B1 * | 1/2004 | Kleeven | 315/502 |
| 7,656,258 | B1 * | 2/2010 | Antaya et al. | 335/216 |
| 2008/0093567 | A1 * | 4/2008 | Gall | 250/493.1 |
| 2011/0193665 | A1 * | 8/2011 | Huang et al. | 335/216 |
| 2013/0328475 | A1 * | 12/2013 | Hashimoto | 313/47 |

FOREIGN PATENT DOCUMENTS

JP 06-077049 A 3/1994

OTHER PUBLICATIONS

Ninomiya S. et al, "RCNP Techniques for Producing Ultra-precise Beams", Cyclotrons and Their Applications 2001, 16 Th International Conference, 2001, p. 94-p. 98, XP002720424 pp. 94-98.

Okumura S. et al, "Magnetic Field Stabilization By Temperature Control Of An Azimuthally Varying Field Cyclotron Magnet", Review of Scientific Instruments, vol. 76, No. 033301, 2005, p. 033301-1-p. 033301-6, XP002720425, 2005.

(Continued)

*Primary Examiner* — Brandon S Cole

(74) *Attorney, Agent, or Firm* — Squire Patton Boggs (US) LLP

(57) ABSTRACT

There is provided a cyclotron including: a hollow yoke including first and second yoke portions facing each other and a side yoke portion connecting the first and second yoke portions to each other; first and second poles provided in the yoke so as to face each other; a coil disposed so as to surround the first and second poles; a D electrode provided between the first and second poles; a power source configured to supply electric power to the coil; a pole temperature detector configured to detect a temperature of at least one of the first and second poles; a yoke temperature detector configured to detect a temperature of the side yoke portion; and a control unit configured to control supply of electric power to the coil by the power source on the basis of detection results of the pole temperature detector and the yoke temperature detector.

3 Claims, 3 Drawing Sheets

(56) References Cited

OTHER PUBLICATIONS

Arakawa K. et al, "Construction and First Year's Operation of the JAERI AVF Cyclotron", Proceedings of Cyclotrons and Their Applications 1992; 13th International Conference, 1992, p. 119-p. 122, XP002720426.

European Search Report application No. 13020130.4 dated Mar. 4, 2014.

* cited by examiner

CYCLOTRON

INCORPORATION BY REFERENCE

Priority is claimed to Japanese Patent Application No. 2012-264564, filed Dec. 3, 2012, the entire content of each of which is incorporated herein by reference.

BACKGROUND

1. Technical Field

The present invention relates to a cyclotron that emits an ion beam.

2. Description of the Related Art

As a technical document regarding an accelerator that emits an ion beam in the related art, for example, Japanese Unexamined Patent Application Publication No. 6-077049 is known. The related art discloses a charged particle accelerator system (synchrotron) which includes a magnetic pole and a coil inside a hollow iron core and in which a temperature sensor and an electric heater are attached to the iron core and an electromagnet is quickly changed to a steady state by adjusting the amount of heat of heating means on the basis of the temperature of the iron core.

SUMMARY

According to an embodiment of the present invention, there is provided a cyclotron including: a hollow yoke including first and second yoke portions facing each other and a side yoke portion connecting the first and second yoke portions to each other; first and second poles provided in the yoke so as to face each other; a coil disposed so as to surround the first and second poles; a D electrode provided between the first and second poles; a power source that supplies electric power to the coil; a pole temperature detector that detects a temperature of at least one of the first and second poles; a yoke temperature detector that detects a temperature of the side yoke portion; and a control unit that controls supply of electric power to the coil by the power source on the basis of detection results of the pole temperature detector and the yoke temperature detector.

DETAILED DESCRIPTION

Figure 1:
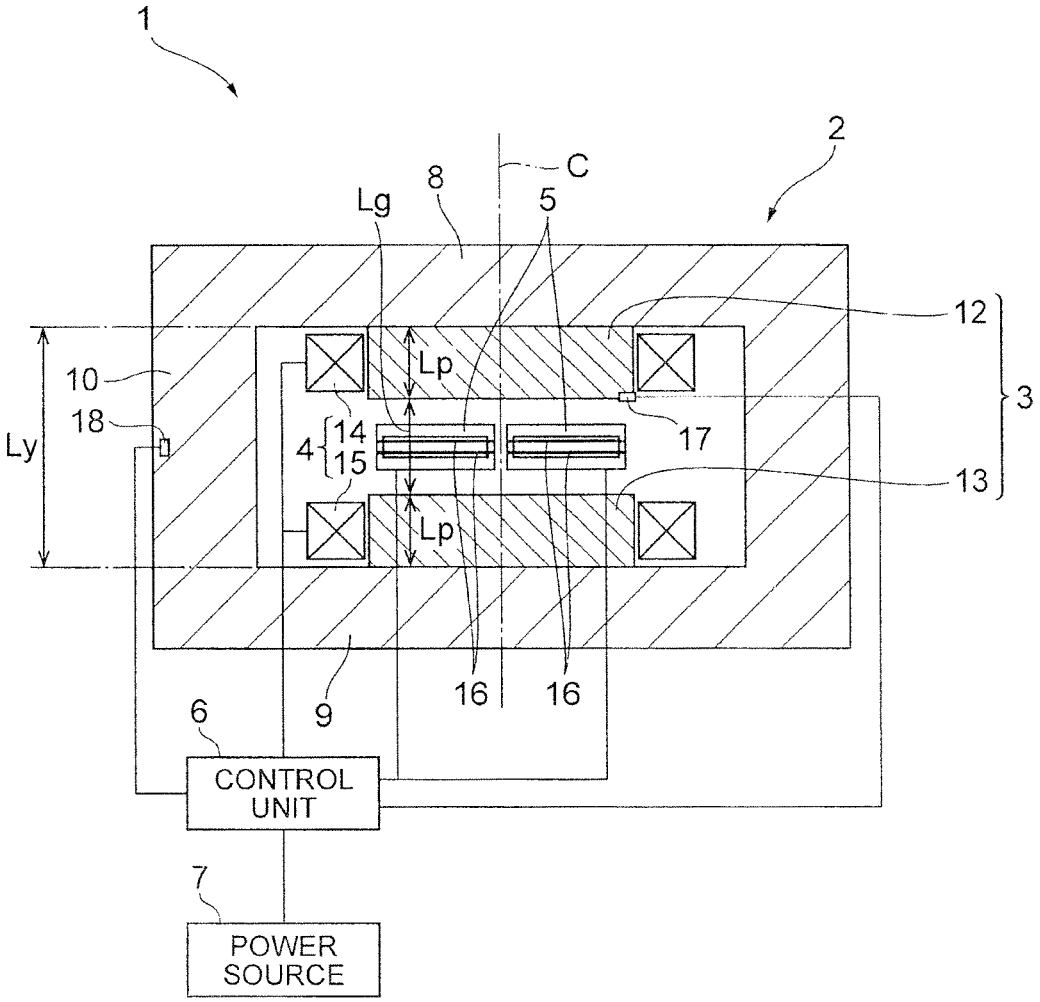
FIG. 1 is a cross-sectional view showing a cyclotron according to one embodiment of the present invention.

Incidentally, in order to stabilize the current value of the ion beam emitted from the cyclotron, it is necessary to accurately control the magnetic field generated from the pole (magnetic pole). However, since the mechanism for directly measuring the magnetic field is large, the cost is increased. In addition, the measurement accuracy of the magnetic field is not sufficient. On the other hand, unlike the synchrotron in the related art described above, a large amount of heat is applied to the pole in the case of a cyclotron. For this reason, magnetic field control based on the pole temperature control is not easy.

It is desirable to provide a cyclotron capable of stabilizing the control of an ion beam.

The present inventor has newly found out that, in the cyclotron, the control of the magnetic field is affected by a temperature change from the room temperature even if the temperature of the pole and the yoke is in the steady state. That is, during the operation of the cyclotron, heat is generated due to a current, which is generated on the opposite surfaces of a pair of poles by the electric field formed by the D electrode, and heat is also applied to the pole due to the collision of a part of the ion beam. When this heat is transmitted from the pole to the yoke to cause thermal expansion in the pole and the yoke, a pole gap that is a distance between the pair of poles is changed. When the pole gap is changed, a generated magnetic field is changed even if the same amount of current is supplied to the coil. As a result, it has been found out that the control of the ion beam becomes unstable.

According to the cyclotron according to the embodiment of the present invention, since the supply of electric power to the coil is controlled on the basis of the temperature of at least one of the first and second poles and the temperature of the side yoke portion, a magnetic field can be accurately controlled reflecting the influence of the change in the pole gap due to temperature even if the pole gap is changed due to thermal expansion of the poles and the yoke. As a result, it is possible to stabilize the control of the ion beam.

In the cyclotron according to the embodiment of the present invention, the yoke temperature detector may be provided at approximate center of the side yoke portion in a direction in which the first and second poles face each other.

According to this cyclotron, the temperature of the side yoke portion can be measured at a position almost equally distant from the first and second poles to which heat is applied. Therefore, compared with a case where the yoke temperature detector is disposed so as to be biased toward one of poles, the average temperature of the side yoke portion can be appropriately detected. As a result, the influence of a change in the pole gap due to temperature can be accurately reflected in control.

In the cyclotron according to the embodiment of the present invention, the pole temperature detector may include a first pole temperature detector provided in the first pole and a second pole temperature detector provided in the second pole.

According to this cyclotron, the influence of a change in the pole gap can be accurately reflected in control by detecting the temperature of both the first and second poles. This is advantageous in stabilizing the control of the ion beam.

Hereinafter, preferred embodiments of the present invention will be described with reference to the drawings. In addition, in each drawing, the same or corresponding sections are denoted by the same reference numerals and a repeated explanation will be omitted.

One Embodiment

As shown in FIG. 1, a cyclotron 1 according to an embodiment is an accelerator that accelerates and outputs an ion beam emitted from an ion source (not shown). As ions that form the ion beam, for example, protons, heavy ions, and the like can be mentioned. The cyclotron 1 is a horizontal type cyclotron in which the central axis C extends in a vertical direction.

The cyclotron 1 is used as a cyclotron for positron emission tomography (PET), a cyclotron for boron neutron capture therapy, a cyclotron for radio isotope (RI) formulation, a cyclotron for neutron sources, a cyclotron for protons, and a cyclotron for deuterons, for example.

The cyclotron 1 according to the present embodiment includes a yoke 2, a pole 3, a coil 4, a D electrode 5, a control unit (control means) 6, and a power source 7.

The yoke 2 is a hollow member formed of iron or iron alloy (for example, cobalt iron alloy), a laminate of silicon copper plates, and the like. The yoke 2 is formed in a hollow disk shape by an upper yoke portion (first yoke portion) 8, a lower yoke portion (second yoke portion) 9, and a side yoke portion 10.

The upper yoke portion 8 and the lower yoke portion 9 are approximately disk-shaped portions facing each other in the extending direction of the central axis C (vertical direction) The outer peripheral sides of the upper yoke portion 8 and the lower yoke portion 9 are connected to each other through the annular side yoke portion 10. Inner space closed by the upper yoke portion 8, the lower yoke portion 9, and the side yoke portion 10 is formed in the yoke 2, and the pole 3 and the coil 4 are disposed in this internal space.

In addition, the upper yoke portion 8, the lower yoke portion 9, and the side yoke portion 10 do not need to be separate members, and may be formed integrally. The side yoke portion 10 does not need to be a single member, and may be formed of a plurality of members. For example, the side yoke portion 10 may be divided vertically. The side yoke portion 10 means a portion located on the side of the internal space of the yoke 2. That is, the length Ly of the side yoke portion 10 in the vertical direction is equal to the length of the internal space in the vertical direction (distance between the upper yoke portion 8 and the lower yoke portion 9).

The pole 3 is a magnetic pole for generating a magnetic field for controlling the ion beam, and is formed of iron or iron alloy (for example, cobalt iron alloy), a laminate of silicon copper plates, and the like, for example. The material of the pole 3 may be the same as the yoke 2, or may be different from the yoke 2.

The pole 3 includes an upper pole (first pole) 12 fixed to the inner surface of the upper yoke portion 8 and a lower pole (second pole) 13 fixed to the inner surface of the lower yoke portion 9. Around the upper pole 12, a first coil 14 is disposed so as to surround the upper pole 12. Similarly, a second coil 15 is disposed around the lower pole 13 so as to surround the lower pole 13.

The upper pole 12 and the lower pole 13 are members having the same shape, and their lengths in the vertical direction (thicknesses) Lp are equal. A pole gap Lg is formed between the upper pole 12 and the lower pole 13. A pair of D electrodes 5 are provided in the pole gap Lg. The pole gap Lg is expressed as in the following Expression (1) using the length Ly of the side yoke portion 10 in the vertical direction and the length Lp of each of the upper pole 12 and the lower pole 13 in the vertical direction. In addition, it is not essential that a pair of D electrodes be provided. For example, one D electrode and one dummy D electrode may be provided.

(Expression 1)

$$Lg=Ly-2Lp \tag{1}$$

The pair of D electrodes 5 is a member for generating an electric field to accelerate the ion beam. The D electrode 5 is a fan-shaped member when viewed from the vertical direction, and has a cavity penetrated in the circumferential direction of the central axis C. In addition, a dummy D electrode 16 corresponding to the circumferential end portion is disposed in the D electrode 5. The D electrode 5 and the dummy D electrode 16 generate an electric field that changes in the circumferential direction by high-frequency AC current applied to the D electrode 5.

The control unit 6 is an electronic control unit that controls the operation of the cyclotron 1. The control unit 6 includes a Central Processing Unit (CPU), a Read Only Memory (ROM), a Random Access Memory (RAM), and the like. The control unit 6 is connected to the coil 4, the D electrode 5, the power source 7, a pole temperature sensor (pole temperature detection means) 17, and a yoke temperature sensor (yoke temperature detection means) 18.

The pole temperature sensor 17 is a sensor that detects the temperature of the upper pole 12. The pole temperature sensor 17 is disposed at the lower end of the right side end portion of the upper pole 12 in FIG. 1.

The yoke temperature sensor 18 is a sensor that detects the temperature of the side yoke portion 10. The yoke temperature sensor 18 is located at the approximate center of the side yoke portion 10 in the vertical direction (direction in which the upper pole 12 and the lower pole 13 face each other) at the left end of the side yoke portion 10 in FIG. 1. The yoke temperature sensor 18 is disposed at a position that is equally distant from the upper pole 12 and the lower pole 13 and is far from the pole temperature sensor 17.

The control unit 6 controls the supply of electric power from the power source 7 to the coil 4 and the D electrode 5. The control unit 6 controls the supply of electric power to the coil 4 and the D electrode 5 on the basis of the detection results of the pole temperature sensor 17 and the yoke temperature sensor 18.

Here, the generation of heat in the cyclotron 1 will be described. During the operation of the cyclotron 1, heat due to current is generated on the opposite surfaces of the upper pole 12 and the lower pole 13 by the electric field generated by the D electrode 5, and heat is also generated when a part of ion beam collides with these opposite surfaces. The heat input to the opposite surfaces of the upper pole 12 and the lower pole 13 is transmitted to the yoke 2 through the upper pole 12 and the lower pole 13.

Specifically, the heat input to the opposite surface of the upper pole 12 is transmitted to the upper yoke portion 8 through the upper pole 12, and a part of the heat is transmitted from the end of the upper yoke portion 8 to the side yoke portion 10. Similarly, the heat input to the opposite surface of the lower pole 13 is transmitted to the lower yoke portion 9 through the lower pole 13, and a part of the heat is transmitted from the end of the lower yoke portion 9 to the side yoke portion 10. Thus, when heat is transmitted to the upper pole 12, the lower pole 13, and the side yoke portion 10, not only the length Lp of each of the upper pole 12 and the lower pole 13 in the vertical direction but also the length Ly of the side yoke portion 10 in the vertical direction is changed due to thermal expansion. As a result, the pole gap Lg is also changed, as shown in the above Expression (1).

Specifically, a variation ΔLg of the pole gap Lg can be expressed as in the following Expression (2) using a variation ΔTy from the reference temperature of the average temperature of the side yoke portion 10, a variation ΔTp from the reference temperature of the average temperature of the upper pole 12 and the lower pole 13, and a linear expansion coefficient α of each of the upper pole 12, the lower pole 13, and the side yoke portion 10.

(Expression 2)

$$\Delta Lg=\alpha(Ly\times\Delta Ty-2Lp\times\Delta Tp) \tag{2}$$

Thus, when the pole gap Lg is changed, a magnetic field between the upper pole 12 and the lower pole 13 is also changed. For this reason, it is necessary to control the magnetic field in consideration of the change in the pole gap Lg due to temperature.

The control unit 6 performs the supply of electric power to the coil 4 in consideration of the change in the pole gap Lg due to temperature on the basis of the detection results of the pole temperature sensor 17 and the yoke temperature sensor 18. Since the cyclotron 1 under operation has a heat distribution in which the side of the upper pole 12 to which heat is input is at a high temperature and the side of the yoke portion 10 is at a low temperature, the control unit 6 controls the supply of electric power in consideration of the distribution of heat from the upper pole 12 to the approximate center of the side yoke portion 10 on the basis of the detection results of the pole temperature sensor 17 and the yoke temperature sensor 18.

In the control unit 6, for example, a change ΔI in the amount of current with respect to the coil 4 can be expressed as in the following Expression (3) using the variation ΔTy from the reference temperature (for example, room temperature) of the average temperature of the side yoke portion 10 and the variation ΔTp from the reference temperature of the average temperature of the upper pole 12 and the lower pole 13. In addition, A and B are coefficients.

(Expression 3)

$$\Delta I = A \times \Delta Ty - 2B \times \Delta Tp \quad (3)$$

Next, the flow of control in the control unit 6 of the cyclotron 1 will be described with reference to FIG. 2.

Figure 2:
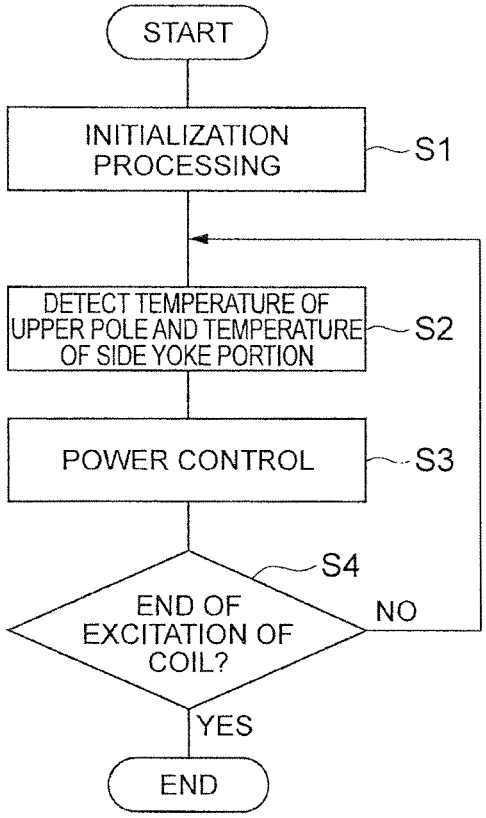
FIG. 2 is a flow chart showing the flow of control of the cyclotron according to one embodiment.

As shown in FIG. 2, in the control unit 6 of the cyclotron 1 according to the present embodiment, predetermined initialization processing is performed when starting the excitation of the coil 4 (step S1). Then, the control unit 6 detects the temperature of the upper pole 12 using the pole temperature sensor 17 and detects the temperature of the side yoke portion 10 using the yoke temperature sensor 18 (step S2). The control unit 6 acquires the detection results of the pole temperature sensor 17 and the yoke temperature sensor 18.

Then, the control unit 6 controls the supply of electric power to the coil 4 and the D electrode 5 on the basis of the detection results of the pole temperature sensor 17 and the yoke temperature sensor 18 (step S3).

Then, the control unit 6 determines whether or not an instruction to end the excitation of the coil 4 has been input (step S4). When it is determined that no instruction to end the excitation of the coil 4 has been input, the control unit 6 returns to step S2 to repeat the process. When it is determined that an instruction to end the excitation of the coil 4 has been input, the control unit 6 ends the excitation of the coil 4. In addition, determination regarding the end of excitation of the coil 4 may be processed in another flow.

According to the cyclotron 1 according to the embodiment described above, since the supply of electric power to the coil 4 is controlled on the basis of the temperature of the upper pole 12 and the temperature of the side yoke portion 10, a magnetic field can be accurately controlled reflecting the influence of the change in the pole gap Lg due to temperature even if the pole gap Lg is changed due to thermal expansion of the pole 3 and the yoke 2. As a result, it is possible to stabilize the control of the ion beam.

In addition, according to the cyclotron 1, since the supply of electric power to the D electrode 5 is controlled on the basis of the temperature of the upper pole 12 and the temperature of the side yoke portion 10, an electric field can be accurately controlled reflecting the influence of the change in the pole gap Lg due to temperature. Therefore, according to the cyclotron 1, it is possible to further stabilize the control of the ion beam by a magnetic field and an electric field by improving the control accuracy of the magnetic field and the electric field.

In addition, according to the cyclotron 1, since the yoke temperature sensor 18 is disposed at the approximate center of the side yoke portion 10 in the vertical direction, the temperature of the side yoke portion 10 can be detected at a position almost equally distant from the upper pole 12 and the lower pole 13 to which heat is applied. Therefore, compared with a case where the yoke temperature sensor 18 is disposed so as to be biased either above or below, the influence of the change in the pole gap Lg due to temperature can be accurately reflected in control by appropriately measuring the average temperature of the side yoke portion 10.

Another Embodiment

Figure 3:
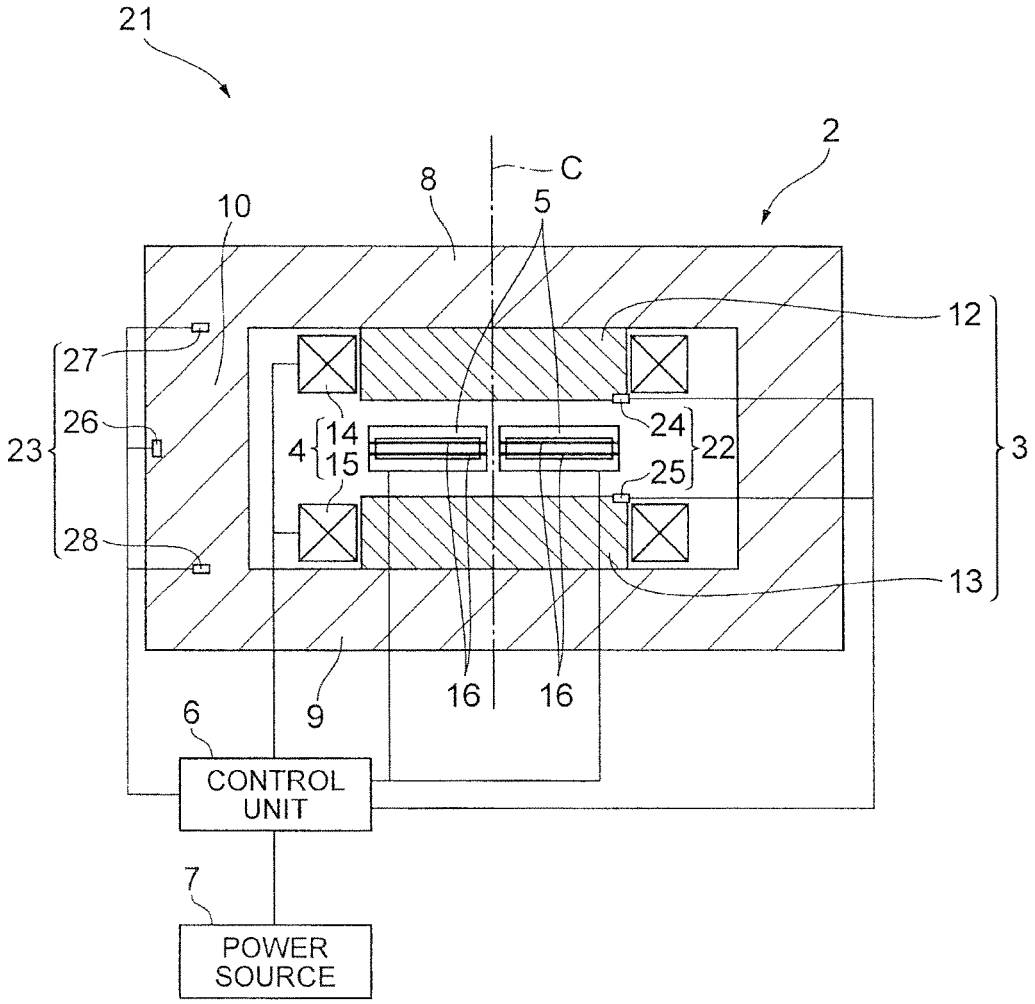
FIG. 3 is a cross-sectional view showing a cyclotron according to another embodiment of the present invention.

As shown in FIG. 3, a cyclotron 21 according to another embodiment is different from the cyclotron 1 according to the above-described embodiment only in that the number of temperature sensors has increased. Since components other than the temperature sensor are the same as in the above-described embodiment, the same reference numerals are given and explanation thereof will be omitted.

Specifically, a pole temperature sensor 22 of the cyclotron 21 includes a first pole temperature sensor 24 that detects the temperature of the upper pole 12 and a second pole temperature sensor 25 that detects the temperature of the lower pole 13. The first pole temperature sensor 24 is disposed at the same position as the pole temperature sensor 17 according to the above-described embodiment. On the other hand, the second pole temperature sensor 25 is disposed at the upper end of a right side end portion of the lower pole 13.

In addition, a yoke temperature sensor 23 includes a first yoke temperature sensor 26 disposed at the approximate center of the side yoke portion 10 in the vertical direction, a second yoke temperature sensor 27 disposed on the boundary of the side yoke portion 10 and the upper yoke portion 8, and a third yoke temperature sensor 28 disposed on the boundary of the side yoke portion 10 and the lower yoke portion 9.

In addition, the boundary of the side yoke portion 10 and the upper yoke portion 8 does not mean the boundary of members. When the side yoke portion 10 and the upper yoke portion 8 are one member, the boundary of a portion located on the side of the internal space of the hollow yoke 2 and a portion located above from the internal space is equivalent to the boundary of the side yoke portion 10 and the upper yoke portion 8. The same is true for a case of the side yoke portion 10 and the lower yoke portion 9.

In the control unit 6 of the cyclotron 21 according to another embodiment, the supply of electric power to the coil 4 and the D electrode 5 is controlled on the basis of the detection results of the first pole temperature sensor 24, the second pole temperature sensor 25, the first yoke temperature sensor 26, the second yoke temperature sensor 27, and the third yoke temperature sensor 28.

According to the cyclotron 21 according to another embodiment described above, the influence of a change in the pole gap can be accurately reflected in control by detecting the temperature of both the upper pole 12 and the lower pole 13. This is advantageous in stabilizing the control of the ion beam. In addition, in the cyclotron 21, since the temperature sensors 27 and 28 can also be symmetrically disposed on the boundary of the upper pole 12 and the lower pole 13 of the side yoke portion 10, the average temperature of the side yoke portion 10 can be detected more accurately. Therefore, since the change in the pole gap Lg due to thermal expansion of the side yoke portion 10 can be more reliably reflected in control, it is possible to further stabilize the control of the ion beam.

The present invention is not limited to the embodiments described above. For example, the cyclotron according to the present invention is not limited to the horizontal type cyclotron in which a pair of poles face each other in the vertical direction, but may be a vertical type cyclotron in which a pair of poles face each other in the horizontal direction.

In addition, the positions or the number of pole temperature sensors and yoke temperature sensors is not limited to that described above. In one embodiment, a temperature sensor may be provided in the lower pole instead of the upper pole, and a temperature sensor may be provided in both the upper pole and the lower pole. In addition, in another embodiment, the number of yoke temperature sensors may be 2 instead of 3. In addition, it is also possible to dispose a temperature sensor on the boundary of the upper pole and the upper yoke or on the boundary of the lower pole and the lower yoke.

It should be understood that the invention is not limited to the above-described embodiment, but may be modified into various forms on the basis of the spirit of the invention. Additionally, the modifications are included in the scope of the invention.

What is claimed is:

1. A cyclotron, comprising:

a hollow yoke including first and second yoke portions facing each other and a side yoke portion connecting the first and second yoke portions to each other;

first and second poles provided in the yoke so as to face each other;

a coil disposed so as to surround the first and second poles;

a D electrode provided between the first and second poles;

a power source configured to supply electric power to the coil;

a pole temperature detector configured to detect a temperature of at least one of the first and second poles;

a yoke temperature detector configured to detect a temperature of the side yoke portion; and a control unit configured to control supply of electric power to the coil by the power source on the basis of detection results of the pole temperature detector and the yoke temperature detector.

2. The cyclotron according to claim 1, wherein the yoke temperature detector is provided at approximate center of the side yoke portion in a direction in which the first and second poles face each other.

3. The cyclotron according to claim 1, wherein the pole temperature detector includes a first pole temperature detector provided in the first pole and a second pole temperature detector provided in the second pole.

* * * * *